United States Patent [19]

Gaines

[11] Patent Number: 4,648,675

[45] Date of Patent: Mar. 10, 1987

[54] ELECTRICAL CONNECTION APPARATUS FOR LIGHTING FIXTURES

[75] Inventor: Bernard S. Gaines, Roslyn Heights, N.Y.

[73] Assignee: Trine Products Corp., Bronx, N.Y.

[21] Appl. No.: 881,578

[22] Filed: Jul. 2, 1986

Related U.S. Application Data

[63] Continuation of Ser. No. 701,340, Feb. 14, 1985, abandoned.

[51] Int. Cl.[4] ..... H01R 4/02

[52] U.S. Cl. ..... 339/97 P; 339/208; 339/210 M

[58] Field of Search ..... 339/97 R, 97 P, 98, 339/99 R, 244 B, 249 B, 272 B, 107, 208, 210 M

[56] References Cited

U.S. PATENT DOCUMENTS

| | | | |
|---|---|---|---|
| 947,754 | 1/1910 | Perkins | 339/272 B |
| 2,668,885 | 2/1954 | Gerlat | 339/107 |
| 2,742,549 | 4/1956 | Reters | 339/97 P |
| 2,758,280 | 8/1956 | More | 339/99 R |
| 3,217,286 | 11/1965 | Duffield | 339/99 R |
| 4,184,734 | 1/1980 | Toorell | 339/107 |
| 4,270,830 | 6/1981 | Brenner | 339/99 R |
| 4,477,132 | 10/1984 | Moser et al. | 339/107 |

*Primary Examiner*—Gil Weidenfeld
*Assistant Examiner*—David Pirlot
*Attorney, Agent, or Firm*—Brooks Haidt Haffner & Delahunty

[57] ABSTRACT

A connector for multiconductor wire comprising a longitudinally divided socket having external threaded segments on one end of respective socket portions, and internally threaded segments on opposite ends of the socket portions. An externally threaded support element mates with the socket internal thread segments thereby applying pressure to a ring disposed between the support element and conductors disposed in a cable receiving area in alignment therewith. Contacts are immovably held between mating faces of the socket portions, and contain contacting portions extending into the conductor-receiving area thereby allowing electrical connection of the conductors and contacting portions upon mating of the support element and internal socket threads.

8 Claims, 11 Drawing Figures

Fig. 5.
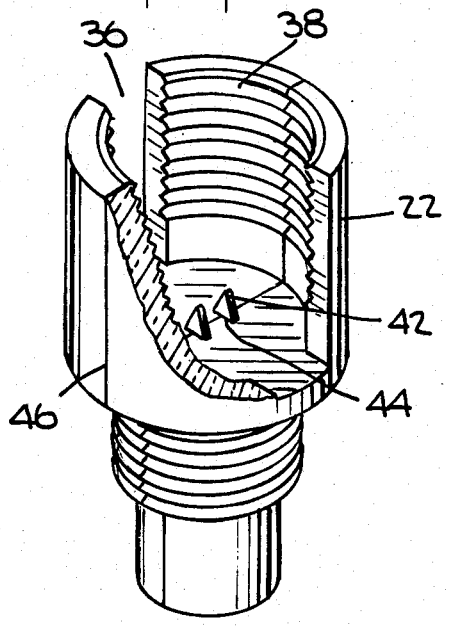
Fig. 6.
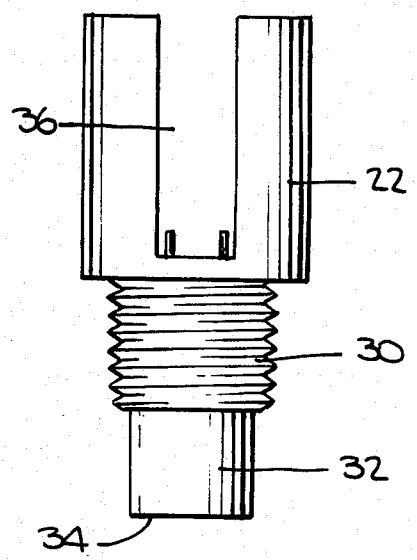
Fig. 7.
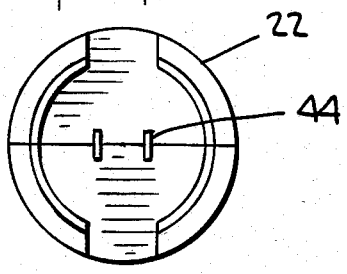
Fig. 8.
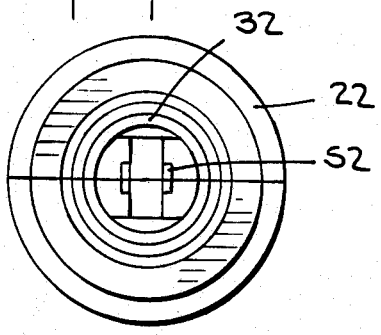
Fig. 9A.
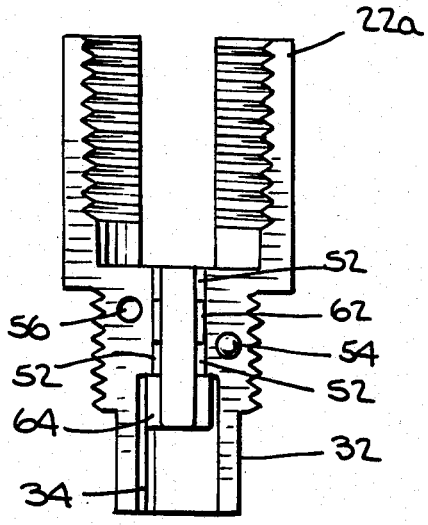
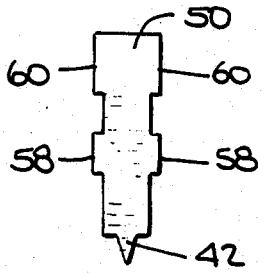
Fig. 10.
Fig. 9B.
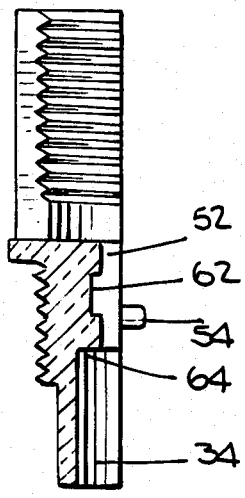

ELECTRICAL CONNECTION APPARATUS FOR LIGHTING FIXTURES

This application is a continuation of application Ser. No. 701,340, filed Feb. 14, 1985, now abandoned.

BACKGROUND OF THE INVENTION

This invention relates to quick fastening devices for illumination apparatus, and in particular relates to electrical connection apparatus allowing an electrical connection to be made at variable positions along an insulated, flexible, electrical wire or conductor.

DESCRIPTION OF THE PRIOR ART

Prior art electrical connections of the type disclosed herein have been made for low voltage lighting primarily used as garden lights for a residence. In the traditional application a garden light is connected to an elongated type spike or rod which is placed in the ground along a walkway or other area desired to be illuminated. The garden light is electrically connected to an electrical source, usually in a nearby residence, by means of a flexible, insulated elongated conductor. Traditional lights of this nature have a plastic or metallic upper section of a "pagoda" type design surrounding a glass cover which houses the light bulb. The upper section connects to a lower section which houses the electrical components for the lamp. This lower section has a threaded opening through which project the electrical leads or conductors which provide the electrical connection to the lamp. A plastic socket mates with the threaded opening of the lower section and provides a means by which the conductors from the lamp may be connected with the flexible cable. The elongated spike is threaded into a base portion of the socket and provides the support for the entire lamp apparatus.

At the top of the spike where it is threaded to the metallic part of the lamp an electric cable is run through the spike such that it is substantially normal to the spike and lamp. The cable is run through a slot in the socket and when the spike is threaded onto the socket the force of the threading causes the conductors to pierce the insulation of the cable and make electrical contact with the lamp components. To move the lamp all that is generally required is to unscrew the spike from the socket thereby disconnecting the connectors from the electrical cable and sliding the lamp along the cable to a new position. The spike is then rethreaded into the socket portion of the lamp causing the connectors to pierce the insulation of the cable at the new location thereby making electrical contact. Since the garden lights are typically of a low voltage design, there is little or no risk of electrical shock or burn.

The socket portion into which the spike is threaded to compress the connectors against the cable has typically been of a single piece design having an inner threaded portion to receive the spike and an outer threaded portion to receive the threaded opening of the lower lampholder section. The electrical conductors from the lamp components project through the socket to the slot where they form a pair of sharpened points projecting into the cable receiving area of the socket. Thus, when the spike is threaded into the socket opening the cable is pressed against the sharpened contactors and the insulation is pierced. Since the socket is of a single piece design numerous manufacturing steps are required in its construction. The piece is normally of a plastic material and must be threaded on both the inside and outside areas, after the molding operation of the socket. A relatively complex mold is required to manufacture the one piece socket. These additional manufacturing steps increase the amount of time it takes to manufacture the socket and thus increase the expense of the part. Further, if the socket breaks in the field, the entire piece must be discarded for a new piece in order to operate the lamp. In the single piece design, the conductors must be fitted through the socket to the area where they will piece the electrical cable. This manner of assembly has developed an inefficient means for making the electrical connection as often the conductors are not firmly held in the socket. When the spike is threaded into the socket a poor connection is made.

Thus, there is a need in the field for a lamp socket to operate in connection with a low voltage outdoor lighting apparatus where the socket may be more economically and efficiently manufactured. Further, there is a need in the field for a socket to be used in connection with a low voltage lighting apparatus for outdoor use where the socket need not be discarded if a portion of it is broken or damaged. Also, there is a need in the field for a socket to be used in conjunction with a low voltage lighting apparatus that will provide a secure and efficient electrical contact between the conductors of the lamp and the flexible cable.

SUMMARY OF THE INVENTION

It is a general object of the present invention to provide a socket to be used in connection with a low voltage lighting apparatus for outdoor purposes where the socket will provide means for making an improved electrical connection with an energized elongated conductor at any point along its length. It is an additional object of the present invention to provide a socket for a low voltage lighting apparatus which requires a limited number of manufacturing steps for its manufacture. It is an additional object of the present invention to provide a low voltage lighting apparatus socket which will be easily replaceable in the field in the event of breakage or damage. It is an object of the present invention to provide a low voltage lighting apparatus socket which will provide means by which electrical contact with the electrical source can be easily and efficiently made.

The objects of the present invention are met by providing a socket assembly to be used in conjunction with a low voltage lighting apparatus for outdoor usage, connectable to an elongated support piece, also called a "spike". The objects of the present invention are satisfied by providing a plastic socket composed of three separate pieces each of which are made in a single molding operation. The socket is formed by combining two half sections together, each half section independently made in a separate mold. Each half section has molded therein inner threaded sections to receive the spike and an outer threaded portion to receive the threaded opening of the lower lampholder section. Each socket half has a pair of grooves therein to receive and restrain the lamp conductors. Each lamp conductor has sharpened, pointed ends to pierce the cable and a set of grooved portions to mate with the socket grooves. A retainer fits over the socket halves to maintain the socket halves together, and provides a means against which the spike will act to push the cable against the sharpened conductors. In this manner, when the spike is threaded into the socket the retaining member forces the cable against the sharpened conductors and makes electrical contact.

When the lamp is desired to be removed, the spike is simply unscrewed allowing the cable to disengage from the sharpened conductors and allowing the lamp apparatus to be moved along the conductor to a new location.

It is felt that the above elements, as will be more fully described below, meet the objects of the invention indicated above and satisfy the needs that have developed in the usage of traditional socket arrangements for low voltage outdoor lights.

BRIEF DESCRIPTION OF THE DRAWINGS

The features of the present invention which are believed to be novel are set forth with particularity in the appended claims. The invention together with further objects and advantages thereof may best be understood by reference to the following description, taken in conjunction with the accompanying drawings in the several figures of which like reference numerals identify like elements, and in which:

FIG. 5 is a top perspective view showing in section the assembled socket having the conductors mounted therein;

FIG. 6 is a side elevational view of the assembled socket having the conductors mounted therein;

FIG. 7 is a bottom view of the assembled socket;

FIG. 8 is a top view of the assembled socket;

FIG. 9*a* is a front elevational view of a socket half;

FIG. 9*b* is a side elevational view of a socket half; and

FIG. 10 is a side elevational view of a lamp conductor.

DETAILED DESCRIPTION

Figure 1:
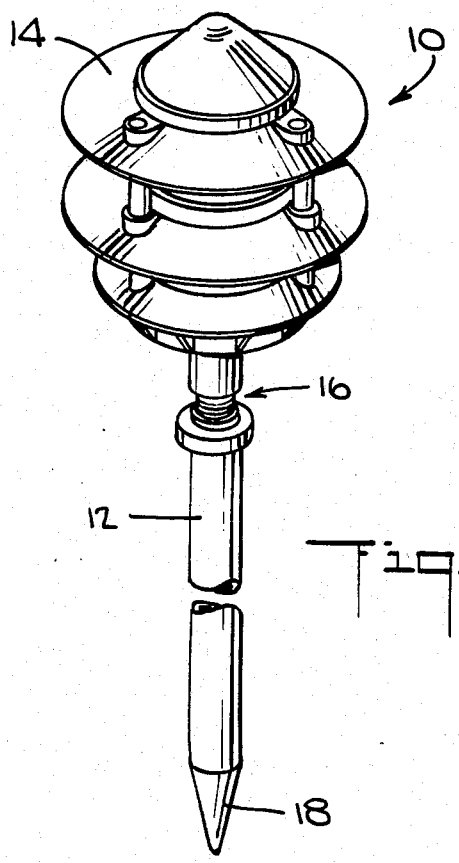
FIG. 1 is a top perspective view of the lamp holder apparatus.

Referring now to the drawings, FIG. 1 shows in perspective view the lamp 10 having spike 12 threaded thereon. Lamp 10 has metal lamp casing 14 which is threaded at socket area 16 onto spike 12. Spike 12 has pointed end 18 which is used to insert the lamp apparatus 10 into the ground to provide support therefore. Spike 12 is made of a rigid PVC plastic having point 18 glued or molded thereon as a separate piece.

Figure 2:
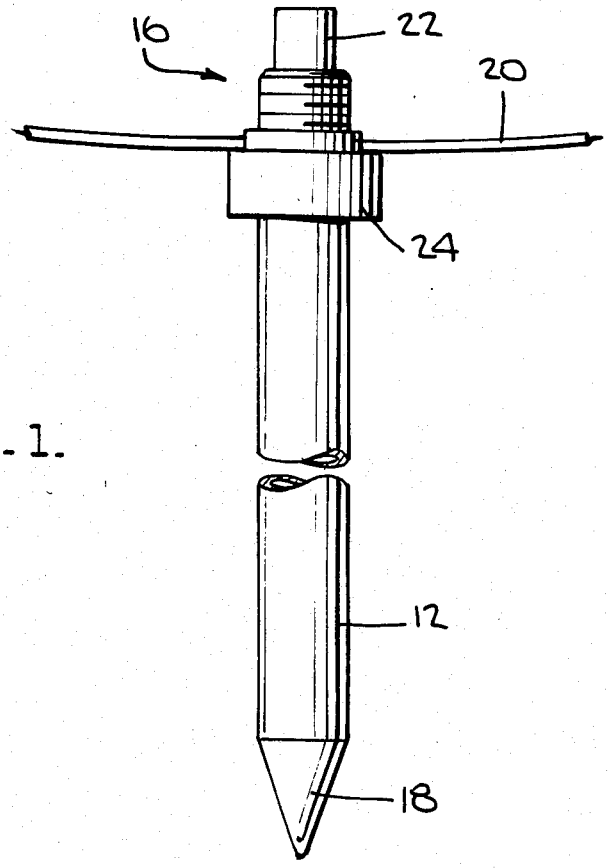
FIG. 2 is a side elevational view of the spike and socket portion of the lamp apparatus.
Figure 4:
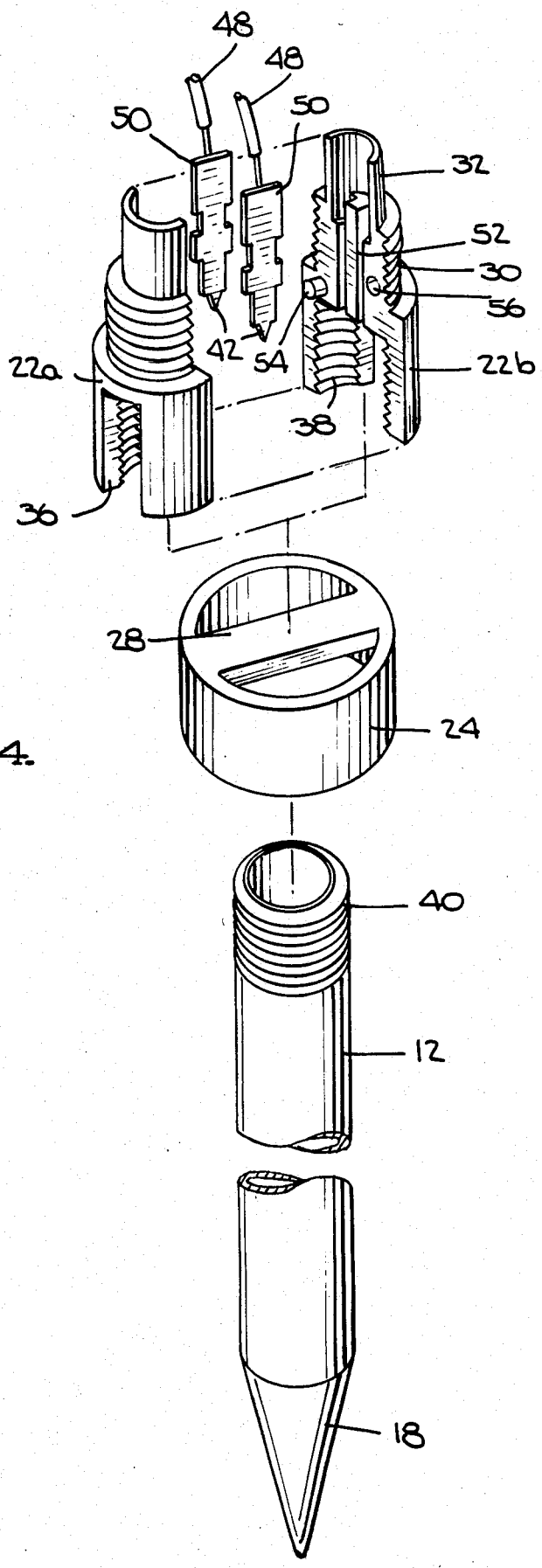
FIG. 4 is an exploded view of the assembled socket and retaining member and spike end.

FIG. 2 shows in side view the arrangement of spike 12 with socket area 16. It is seen that elongated cable 20 projects through socket area 16. It is in socket area 16 that the electrical connection is made with cable 20 for the lamp apparatus. Cable 20 carries the electrical power to the lamp apparatus 10. In its normal use, multiple lamp apparatuses will be placed along a single cable 20 such as where they are used to light a walkway to a residence. Socket area 16 has socket 22 threaded to spike 12. Retaining ring 24 is also mounted over spike 12 and interacts with socket 22 as will be explained in more detail below. FIG. 4 shows the relationship of spike 12, retaining ring 24, and socket 22. It should be noted that retaining ring 24 has unthreaded opening 26 and bar 28. Socket 22 has upper, outer threaded area 30 with conductor guide area 32 and opening 34. Also, socket 22 has slot 36 formed therein which receives bar 28 of retaining ring 24. Also, as can be noted in FIG. 4 the inner area of socket 22 has inner threaded portion 38 therein. Bar 28 fits within slot 36 of the socket. Bar 28 also provides a means by which the conductor 20 will be received through slot 36 and will have a portion against which the conductors will be compressed into cable 20 to make an electrical connection, as will be explained below. Spike 12 has upper threaded portion 40 which mates with the threaded section 38 of socket 22.

Conductor guide area 32, shown in FIG. 4 has opening 34 which provides a means by which the conductors which connect the electrical apparatus of the lamp 10 are transmitted to the inner portion of the socket 22 where they will mate with the cable 20. By screwing the upper threaded portion 40 of spike 12 into the inner threaded area 38 of socket 22 the retaining ring 24 is moved inwardly along slot 36 thus causing bar 28 to compress conductor 20 which is received within slot 36.

FIG. 5 shows socket 22 in a cut away view showing clearly the inner threaded opening 38 and a portion of the slot area 36. In FIG. 5 socket 22 is shown in an inverted position to better illustrate the conductor tips 42 which project through openings 44 in socket 22. These conductor tips 42 provide the means by which the outer insulated area of cable 20 is pierced to make electrical connection with the lamp elements. Conductor tips 42 are electrically connected to the lamp elements through conductor guide area 32 which is received into the metal casing area 14 of lamp 10. Line 46 designates the split section of socket 22 which is shown in more detail in FIG. 3.

Figure 3:
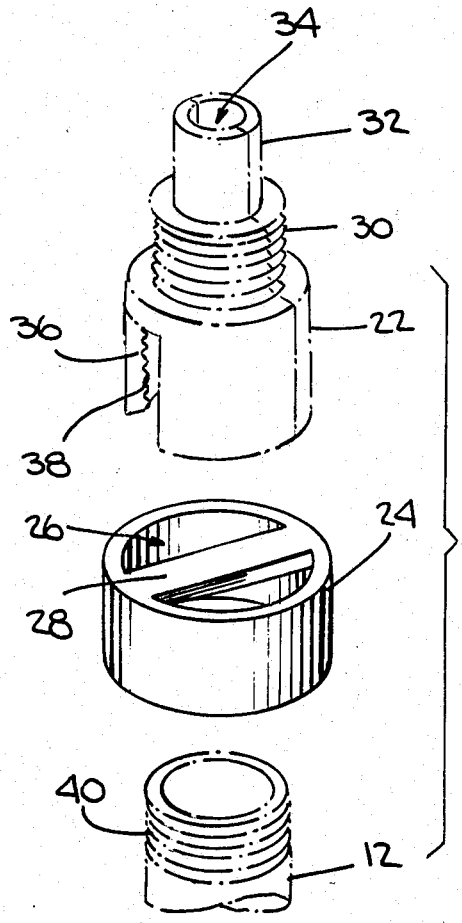
FIG. 3 is an exploded perspective view of the spike, socket, retaining member, and conductors for the lamp apparatus.

Referring now to FIG. 3 it is seen that the socket 22 is comprised of two half sections 22*a* and 22*b*. By forming socket 22 into two half sections 22*a* and 22*b*, the entire socket half section may be made in a single molding step. Individual molds are required for each section 22*a* and 22*b*, however, the threads for the inner threaded portion 38 and the outer threaded area 30 may be formed in the mold rather than by a cutting process which is an additional step.

Guide slots 52 are also molded on the inner side of socket 22*a* and socket 22*b*. These guide slots receive leads 50 which contain at their outer ends the conductor tips 42. The conductors 48 are connected at the other end of leads 50 which connect to the electrical elements of the light fixture in the lamp apparatus 10. Projection 54 is molded in socket 22*b* as shown in FIG. 3 with a corresponding projection 54 molded in socket 22*a*. Opening 56 is also molded as shown in socket 22*b* with a corresponding opening 56 molded in socket 22*a*. When mated, socket halves 22*a* and 22*b* are joined by having projections 54 mate with openings 56. This helps hold the socket halves 22*a* and 22*b* together to form the single socket 22. Additionally, retaining ring 24 is slipped over the mated socket halves 22*a* and 22*b* to hold the socket halves in place. As stated before, retaining ring 24 slips over socket 22 such that bar 28 is received in slot 36 of socket 22. When upper threaded portion 40 of spike 12 is threaded into the mated socket 20, the combination of the retaining ring 24 and the threading of upper end 40 into inner threaded portion 38 of socket 22 secure the assembly together.

FIG. 10 illustrates in greater detail the leads 50. As stated previously, leads 50 have conductor tips 42 projecting therefrom. Also, leads 50 have projections 58 on each side thereof approximately midway between the opposing ends of leads 50. Projections 60 are shown at the end opposite the end containing the conductor tips 42. FIGS. 9*a* and 9*b* show a side and section view of socket half 22*a*. Socket half 22*b* is shown in detail in FIG. 3 and is identical to socket half 22*a* shown in FIG. 9*a* with the exception that projection 54 and opening 56 are reversed on socket 22*b* to provide the means by which the projections 54 will mate with openings 56 when socket halves 22*a* and 22*b* are joined together. Lead slots 52 are shown in FIG. 9*a* having a reduced or an increased depth section 62. This increased depth section 62 receives the projections 58 on leads 50 when the leads 50 are inserted in lead slots 52. The projections 58 and increased depth sections 62 interact to provide a means by which the leads 50 will be firmly mounted in the lead slots 52 allowing the conductor tips 42 to project into the cable 20. The projection of the conductor tips 42 is shown again in FIG. 5 when the socket assembly is assembled. Projections 60 of leads 50 fit in lead slots 52 at end 64 where an increased depth section is provided for projections 60. The conductors 38 shown in FIG. 3 when mounted in lead slots 52 as described above would project through conductor guide area 32 to be connected with the lamp elements. FIG. 9*b* shows in section view the detail of lead slots 52. Again, the increased depth section 62 is shown in lead slot 52 in FIG. 9*b*. Area 64 along lead slot 52 receives the projection 60 of the lead 50. These increased depth sections 62 and 64 act to maintain the lead 50 in the desired location within socket 22. Both sockets 22*a* and 22*b* have a similar configuration for lead slots 52. Thus, both act to hold the lead 50 in place when the sockets are mated.

FIG. 7 shows the mated socket 22 and the conductor tip openings 44. It is seen that these openings are each formed by a half section of the socket and by the joining of the sockets together.

FIG. 8 illustrates a top view of socket 22 showing the lead slots 52 formed by the mating of socket halves 22*a* and 22*b*.

When assembled, the conductor 20 is slipped through the slot 36 in socket 22 and the spike 12 has threaded upper end 40 threaded into inner threaded portion 38 of the socket 22. This forces the retaining ring 24 against the cable 20's insulation against the conductor tips 42. Once the insulation of conductor 20 is pierced by conductor tips 42 an electrical contact is made to the lamp elements. The spike 12 is continued to be threaded into the inner threaded portion 38 of socket 22 until a secure and firm connection, both mechanically and electrically, is formed. The lamp apparatus 10 is retained in this position for as long as its use is desired. When a movement of the lamp apparatus with respect to the cable 20 is desired, the spike 12 is removed from the ground and the upper threaded portion 40 is unthreaded with respect to the inner threaded portion 38. This removes the pressure from the cable 20 and allows cable 20 to be removed from the conductor tips 42 such that the entire lamp apparatus may be removed with respect to cable 20 to a new location. At the new location the spike 12 is again tightened into inner threaded opening 38 until the conductor tips pierce the cable 20 insulation and provide a new electrical connection. In view of the low voltage rating of the lamp apparatus, the previous puncture marks made by the conductor tips 42 do not cause a shock or burn hazard.

The above invention provides a unique and efficient means of manufacturing a socket 22 to be used in connection with an outdoor lamp apparatus. In a single molding step the socket is formed. This socket not only provides a reduced cost to manufacture, but also provides a means by which an increased and better mechanical and electrical connection is made between the conductor tips and the electrical cable 20.

The invention described above is not limited to the particular details of construction of the device depicted, and other modifications and applications may be made. For example, a different shape may be used for the leads 50 and the projections 58 and 60 such that a firm and secure mechanical and electrical connection may still be maintained in the slots 52. Also, the slots 36 in socket 22 may be arranged at a location other than that shown with respect to section line 46. Certain other changes may be made in the above described device without departing from the true spirit and scope of the invention herein involved. It is intended therefore that the subject matter of the above description shall be interpreted as illustrative and not in a limiting sense.

What is claimed is:

1. An electrical connector for providing an electrical connection between an electrical device and a multiconductor cable with insulation around the conductors, said connector comprising:

a socket having a hollow and internally threaded lower portion extending around an axis and defining a cable receiving area and providing an opening for receiving an externally threaded support member, having an upper portion and having slots in the lower portion and at opposite sides of said axis for receiving a cable and permitting it to extend through said cable receiving area, said socket comprising a pair of molded half sections matable along a plane extending substantially parallel to said axis;

each said half section comprising, in the lower portion thereof, molded internal thread portions which mate with the internal threads of the mating other half section to form said internally threaded portion of said socket and comprising, in the upper portion thereof, a pair of spaced conductor lead receiving grooves which extend in the direction of said axis and which mate with the grooves of the other half section to form conductor lead receiving grooves which restrain conductor leads therein with respect to axial and circumferential movement when the half sections are mated to form said socket;

a pair of conductor leads each having a pointed end, one conductor lead mounted in one of said pair of grooves of one of said half sections and one of said pair of grooves of the other half section with the pointed end thereof extending into said cable receiving area and the other conductor lead mounted in the other of said pair of grooves of said one of said half sections and in the other of said pair of grooves of said other half sections with the pointed end thereof extending into said cable receiving area, each of said pair of conductor leads being removable from said pair of grooves upon separation of said socket half sections and being restrained from axial and circumferential movement when in said pair of grooves and said socket half sections are in mating relationship;

means for retaining said half sections in mating relation; and means in said lower portion of said socket for engaging a cable within said cable receiving area and pressing it against said pointed end of each conductor lead for thereby contacting a conductor lead with a conductor of said cable.

2. An electrical connector as set forth in claim 1 wherein said upper portion of each half section has molded exterior threads for threadedly receiving said electrical device.

3. An electrical connector as set forth in claim 1 wherein one said half section has a projection thereon and the other said half section has a recess therein for receiving said projection of said one half section and maintaining said one half section and said other half section concentric with said axis.

4. An electrical connector as set forth in claim 1 wherein said means for retaining said half sections in mating relation comprises a ring encircling and contacting said lower portion of each half section.

5. An electrical connector as set forth in claim 4 wherein said means for engaging a cable within said cable receiving area comprises a bar integral with said ring and extending diametrically thereof, said bar being receivable in said slots.

6. An electrical connector as set forth in claim 5 further comprising an externally threaded support means engaging the threads of said internally threaded portion of said socket and engaging the threads of said internally threaded portion of said socket and a portion of said ring whereby upon threading of said support means into said internally threaded portion of said socket, said bar is pressed against a cable within said cable receiving area and presses the conductor of said cable against the pointed ends of said conductor leads.

7. An electrical connector as set forth in claim 1 wherein each half section has a portion extending transversally to the axis thereof adjacent to the lower ends of said pairs of grooves thereof and wherein said pointed end of each said conductor lead extends below the last-mentioned said portion so that said pointed end of each said conductor lead is exposed in said cable receiving area.

8. An electrical connector as set forth in claim 7 wherein each conductor lead is relatively long and narrow and has lengthwise spaced portions extending from sides thereof and wherein said pair of grooves of each half section have configurations conforming to the shapes of said conductor leads.

* * * * *